US009534300B2

(12) United States Patent
Gill et al.

(10) Patent No.: US 9,534,300 B2
(45) Date of Patent: Jan. 3, 2017

(54) WATER SOLUBLE SUBSTITUTED IMIDAZOLINES AS CORROSION INHIBITORS FOR FERROUS METALS

(71) Applicant: Ecolab USA, Inc., Naperville, IL (US)

(72) Inventors: Jasbir S. Gill, Naperville, IL (US); Peter E. Reed, Plainfield, IL (US); Santanu Banerjee, Pune (IN); Anand Harbindu, Shahjahanpur (IN)

(73) Assignee: ECOLAB USA INC., Naperville, IL (US)

( * ) Notice: Subject to any disclaimer, the term of this patent is extended or adjusted under 35 U.S.C. 154(b) by 386 days.

(21) Appl. No.: 14/295,784

(22) Filed: Jun. 4, 2014

(65) Prior Publication Data

US 2015/0354067 A1 Dec. 10, 2015

(51) Int. Cl.

| | |
|---|---|
| ***C23F 11/00*** | (2006.01) |
| ***C23F 11/04*** | (2006.01) |
| ***C23F 11/06*** | (2006.01) |
| ***C02F 5/02*** | (2006.01) |
| ***C23F 11/14*** | (2006.01) |
| ***C23F 11/08*** | (2006.01) |

(52) U.S. Cl.

CPC ..... *C23F 11/149* (2013.01); *C23F 11/08* (2013.01)

(58) Field of Classification Search

CPC ..... A61L 2/00; C07D 401/12; A61K 45/06
USPC ... 422/7, 12–14, 17; 134/22.1; 252/175, 387
See application file for complete search history.

(56) References Cited

U.S. PATENT DOCUMENTS

| | | | | |
|---|---|---|---|---|
| 2,889,193 | A | 6/1959 | Denman et al. | |
| 2,889,334 | A | 6/1959 | Hughes | |
| 5,062,992 | A | 11/1991 | McCullough | |
| 5,322,640 | A | 6/1994 | Byrne et al. | |
| 5,425,914 | A | 6/1995 | Brown et al. | |
| 6,303,079 | B1 * | 10/2001 | Meyer | C07D 233/18 106/14.12 |
| 7,057,050 | B2 | 6/2006 | Meyer | |
| 7,087,569 | B2 | 8/2006 | Lentsch et al. | |
| 7,135,448 | B2 * | 11/2006 | Lentsch | C11D 3/0073 510/220 |
| 7,196,045 | B2 | 3/2007 | Lentsch et al. | |
| 7,524,803 | B2 | 4/2009 | Lentsch et al. | |
| 7,759,299 | B2 | 7/2010 | Smith et al. | |
| 7,858,574 | B2 | 12/2010 | Smith et al. | |
| 8,021,493 | B2 | 9/2011 | Smith et al. | |
| 8,303,768 | B2 | 11/2012 | Shevchenko et al. | |
| 2013/0161265 | A1 | 6/2013 | Fox et al. | |
| 2013/0233796 | A1 | 9/2013 | Rao et al. | |
| 2013/0233804 | A1 | 9/2013 | Xie et al. | |

FOREIGN PATENT DOCUMENTS

| | | | |
|---|---|---|---|
| EP | 0526251 | A1 | 2/1993 |

* cited by examiner

*Primary Examiner* — Monzer R Chorbaji
(74) *Attorney, Agent, or Firm* — Eric D. Babych; Brinks Gilson & Lione

(57) ABSTRACT

Corrosion inhibitors and methods for inhibiting or reducing corrosion of metallic surfaces are provided. A corrosion inhibitor composition may include a water soluble substituted imidazoline or a hydrolysis product thereof. A method of inhibiting corrosion of a metallic surface in an aqueous system includes the step of contacting the surface with an effective amount of a corrosion inhibitor composition. The corrosion inhibitor composition may include other components, such as zinc, and it may also exclude phosphorus.

15 Claims, 3 Drawing Sheets

Corrosion data of $C_6$ acrylated amino imidazoline with Zn

Corrosion data of water soluble acrylated amino and amido imidazolines

Corrosion data of $C_6$ acrylated amino imidazoline with Zn

Corrosion data of $C_6$ acrylated amino imidazoline in high chloride water chemistry conditions

WATER SOLUBLE SUBSTITUTED IMIDAZOLINES AS CORROSION INHIBITORS FOR FERROUS METALS

FIELD OF THE INVENTION

The present disclosure generally relates to corrosion control. More particularly, the disclosure pertains to the use of water soluble substituted imidazolines to reduce or inhibit corrosion of surfaces comprising ferrous metals.

DESCRIPTION OF THE RELATED ART

Carbon steel corrosion inhibition has evolved over many decades from the use of chromate to the current heavy metals and phosphate chemistries. Several decades ago, chromate was banned and was predominantly replaced by molybdenum, zinc, silicate and phosphate. Several advances have been made in the phosphate chemistries from the use of orthophosphate to polyphosphate and the use of organic phosphates, phosphonates, and phosphinates. Currently, phosphorus is under environmental pressure and may only be used in very low-level quantities.

Ferrous metals, such as carbon steel, are among the most commonly used structural materials in industrial systems. Loss of the metals from surfaces resulting from general corrosion causes deterioration of the structural integrity of the system or structure because of reduction of mechanical strength. Localized corrosion (e.g. pitting) may pose an even greater threat to the normal operation of the system than general corrosion because such corrosion will occur intensely in one particular location and may cause perforations in the system structure carrying an industrial water stream. These perforations may cause leaks which require shutdown of the entire industrial system so that repair can be made. Indeed, corrosion problems usually result in immense maintenance costs, as well as costs incurred as a result of equipment failure. Therefore, the inhibition of metal corrosion in industrial water is critical.

Corrosion protection of ferrous metals in industrial water systems is often achieved by adding a corrosion inhibitor. Many corrosion inhibitors, including chromate, molybdate, zinc, nitrite, orthophosphate, and polyphosphate have been used previously, alone or in combination, in various chemical treatment formulations. However, these inorganic chemicals can be toxic, detrimental to the environment, and/or not very effective against localized corrosion, especially at economically feasible and/or environmentally acceptable low dosage levels. Although certain long chain fatty acid containing imidazoline derivatives are known as corrosion inhibitors in the oil and energy industries, they are limited in use for industrial cooling water treatment or treatment of other aqueous systems due to their insolubility in water.

Corrosion has also been managed by using more corrosion-resistant materials, applying protective coatings, and/or using sacrificial anode or chemical treatment. Since aqueous corrosion has been shown to consist of, for most part, an electrochemical process, the chemical treatments have been applied as anodic inhibitors, cathodic inhibitors, or a combination of cathodic and anodic inhibitors.

BRIEF SUMMARY

The present disclosure relates to corrosion inhibitor compositions and methods for inhibiting corrosion. In one aspect, a corrosion inhibitor composition is provided comprising the following general structure or a hydrolysis product or salt thereof:

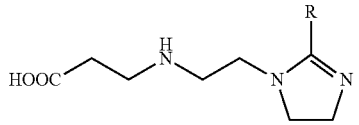

wherein R is a $C_1$-$C_{18}$ alkyl group or H.

In an additional aspect, a method of inhibiting corrosion of a metallic surface in an aqueous system is provided. The method comprises contacting the metallic surface with an effective amount of a corrosion inhibitor composition, wherein the corrosion inhibitor composition comprises the following general structure or a hydrolysis product or salt thereof:

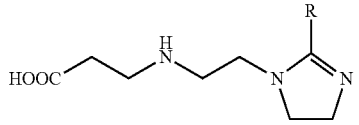

wherein R is a $C_1$-$C_{18}$ alkyl group or H and the effective amount is from about 1 ppm to about 500 ppm.

In a further aspect, a corrosion inhibitor composition is provided comprising the following general structure or a hydrolysis product or salt thereof:

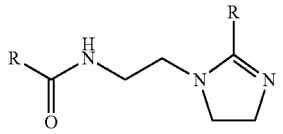

wherein R is a $C_1$-$C_{18}$ alkyl group or H.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which.

DETAILED DESCRIPTION

Figure 1:
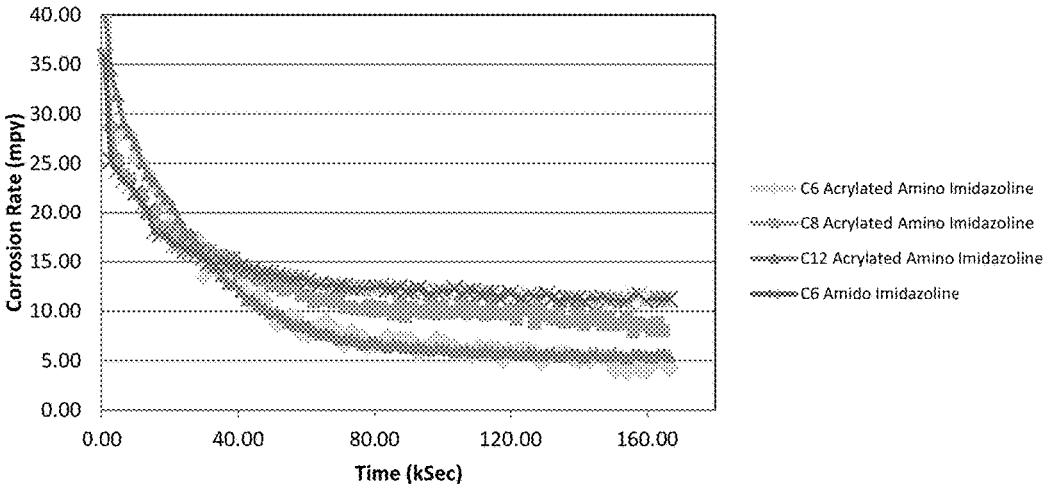
FIG. 1 shows a corrosion data plot for certain water soluble amino, amido imidazolines and their acrylated derivatives.

Various embodiments are described below. The relationship and functioning of the various elements of the embodiments may better be understood by reference to the following detailed description. However, embodiments are not limited to those illustrated below. In certain instances, details may have been omitted that are not necessary for an understanding of embodiments disclosed herein.

The present disclosure relates to corrosion inhibitor compositions and various methods for inhibiting corrosion. The corrosion inhibitor compositions include substituted imidazolines. The corrosion inhibitor compositions can effectively inhibit or prevent corrosion of surfaces comprising metals. In some aspects, the metals are ferrous metals, such as steel, iron, and alloys of iron with other metals, such as stainless steel. In certain aspects of the present disclosure, the corrosion inhibitor composition does not contain phosphorous or any heavy metal ions. The corrosion inhibitor composition may contain functionalities that enhance the corrosion inhibitor composition's affinity for metallic surfaces, such as surfaces comprising iron.

The presently disclosed corrosion inhibitor compositions show strong efficacy as corrosion inhibitors for surfaces comprising carbon steel metallurgy, ferrous metals, and the like. The corrosion inhibitor compositions can achieve a high level of corrosion inhibition without the use of chemistries containing phosphorus and such high levels of corrosion inhibition, such as less than 3 mpy, may also be achieved when using only a small amount of the presently disclosed corrosion inhibitor compositions.

In some aspects of the present disclosure, the corrosion inhibitor composition comprises one or more water soluble substituted imidazolines and/or one or more water soluble substituted amino imidazolines. In certain aspects, the corrosion inhibitor compositions comprise one of the following general structures:

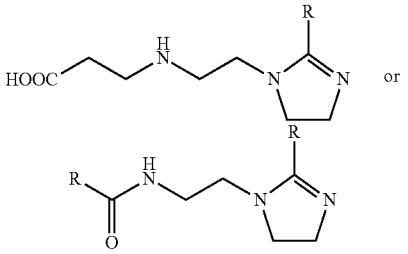

wherein R may be selected from any alkyl group or hydrogen (H). In some aspects, the alkyl group is a $C_1$-$C_{18}$ alkyl group including any sub-range thereof. In some aspects, the alkyl group is a $C_1$-$C_5$ alkyl group. In other aspects, the alkyl group is a $C_6$-$C_{11}$ alkyl group. In further aspects, the alkyl group is a $C_{12}$-$C_{18}$ alkyl group. In still other aspects, the alkyl group is a $C_7$-$C_{17}$ alkyl group. For example, the alkyl group may be a $C_1$ alkyl group, a $C_2$ alkyl group, a $C_3$ alkyl group, a $C_4$ alkyl group, a $C_5$ alkyl group, a $C_6$ alkyl group, a $C_7$ alkyl group, a $C_8$ alkyl group, a $C_9$ alkyl group, a $C_{10}$ alkyl group, a $C_{11}$ alkyl group, a $C_{12}$ alkyl group, a $C_{13}$ alkyl group, a $C_{14}$ alkyl group, a $C_{15}$ alkyl group, a $C_{16}$ alkyl group, a $C_{17}$ alkyl group, or a $C_{18}$ alkyl group. Again, the alkyl group may be any alkyl group or an alkyl group containing from 1 to 18 carbon atoms.

In accordance with certain aspects of the present disclosure, the corrosion inhibitor composition may be selected from the group consisting of $C_6$ acrylated amino imidazoline: 3-((2-(2-pentyl-4,5-dihydro-1H-imidazol-1-yl)ethyl)amino)propanoic acid, $C_8$ acrylated amino imidazoline: 3-((2-(2-heptyl-4,5-dihydro-1H-imidazol-1-yl)ethyl)amino)propanoic acid, $C_{12}$ acrylated amino imidazoline: 3-((2-(2-undecyl-4,5-dihydro-1H-imidazol-1-yl)ethyl)amino)propanoic acid, and $C_{18}$ acrylated amino imidazoline: 3-((2-(2-heptadecyl-4,5-dihydro-1H-imidazol-1-yl)ethyl)amino)propanoic acid.

In some embodiments, the presently disclosed imidazoline corrosion inhibitor compositions may exist in an ionized form in water. For example, a corrosion inhibitor composition according to the present disclosure covers a composition having the following structure:

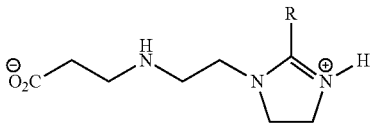

In some embodiments, the presently disclosed imidazoline corrosion inhibitor compositions will hydrolyze in water, thereby forming hydrolysis products or a hydrolysis product. The present disclosure is intended to cover these hydrolysis products of the imidazolines. In one embodiment, the hydrolysis products are exemplified as follows:

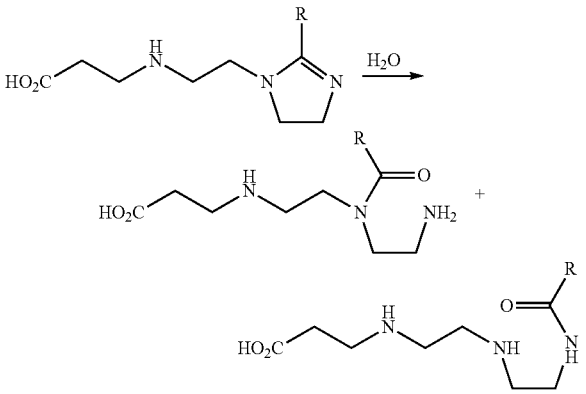

In general, the presently disclosed corrosion inhibitor compositions can be made using any of the known procedures in the art. For example, the corrosion inhibitor compositions can be produced by reacting a fatty acid with diethylene triamine followed by derivatization with acrylic acid. An appropriate reaction temperature may be selected by one of ordinary skill in the art. The fatty acid may be any fatty acid. In some aspects, the fatty acid contains from about 1 to about 18 carbon atoms. For example, the fatty acid may be selected from the group consisting of caproic acid, caprylic acid, lauric acid, and stearic acid.

In some aspects, the fatty acids and diethylene triamine may be present in the reaction in ratio of about 1:1. The temperature of this reaction may be selected by one having ordinary skill in the art. As an illustrative example, the temperature may range from about 180° C. to about 225° C.

This reaction is followed by derivatization with acrylic acid and again, the reactants may be present in a ratio of about 1:1. The temperature of the derivatization reaction may be selected by one having ordinary skill in the art. As an illustrative example, the temperature may be about 120° C. Solvents need not be utilized in these reactions as they are self-condensation reactions.

In some aspects of the present disclosure, the corrosion inhibitor composition excludes phosphorus. In certain aspects, the corrosion inhibitor composition may comprise additional inhibitors. An illustrative example of an additional inhibitor is zinc.

The zinc component may come from an inorganic salt which comprises zinc and/or the zinc component may come from an organic salt which comprises zinc. Illustrative, non-limiting examples of inorganic salts comprising zinc are zinc chloride, zinc nitrate, zinc nitrite, and zinc sulfate. Illustrative, non-limiting examples of organic salts comprising zinc are zinc acetate and zinc citrate.

The present inventors have unexpectedly discovered a strong synergism between the presently disclosed corrosion inhibitor compositions and zinc, and this synergism is also expected to be achieved using the presently disclosed corrosion inhibitor compositions in combination with silicate, borate, aluminate, and/or phosphate.

In terms of the relative amounts of the corrosion inhibitor composition and the zinc when used together, a ratio of the corrosion inhibitor composition to zinc may be from about 15:1, about 12.5:1, about 10:1, about 7.5:1, about 4.5:1, about 1:1, or any ratio therebetween.

In some aspects, an effective amount, such as from about 1 ppm to about 500 ppm, of the corrosion inhibitor composition may be added to an aqueous system containing surfaces susceptible of corrosion. The surfaces may comprise carbon steel metallurgy, ferrous metals, and the like. The corrosion inhibitor composition may be added directly onto the surface or the corrosion inhibitor composition may be added to the water of an aqueous system which comprises the surface to be treated.

The effective amount is not limited and may be appropriately selected by one of ordinary skill in the art depending upon the particular aqueous system, the water chemistry, etc. In some aspects, the effective amount is from about 2 ppm to about 200 ppm. In other aspects, the effective amount is from about 5 to about 100 ppm. In still other aspects, the effective amount is less than about 35 ppm. In one particular aspect, the effective amount is from about 10 ppm to about 25 ppm.

In certain aspects of the present disclosure, an effective amount of zinc may be added directly to the surface to be treated or it may be added to the aqueous system containing one or more surfaces susceptible of corrosion along with the corrosion inhibitor composition. Each component may be added separately or as a mixture and the addition may be manual addition or automatic addition using chemical injection pumps and the automated system described below. In some aspects, the effective amount of zinc is from about 0.5 ppm to about 10 ppm. In other aspects, the effective amount of zinc is from about 2 ppm to about 5 ppm.

In one particular aspect, zinc is added as about 2 ppm active zinc and a ratio of corrosion inhibitor composition to zinc is about 12.5:1 (i.e. about 25 ppm active corrosion inhibitor composition to about 2 ppm active zinc). Zinc may act as a cathodic corrosion inhibitor and corrosion inhibition may improve with higher amounts of zinc.

The presently disclosed corrosion inhibitor compositions may be used in any aqueous system comprising surfaces susceptible of corrosion. For example, the corrosion inhibitor compositions may be used in once-through, open loop, or closed loop recirculating cooling water systems. Other aqueous systems include, but are not limited to, systems used in petroleum production and oil recovery (e.g., well casing, transport pipelines, etc.) and refining, geothermal wells, and other oil field applications; boilers and boiler water systems; systems used in power generation, mineral process waters including mineral washing, flotation and benefaction; paper mill digesters, washers, bleach plants, white water systems and mill water systems; black liquor evaporators in the pulp industry; gas scrubbers and air washers; continuous casting processes in the metallurgical industry; air conditioning and refrigeration systems; building fire protection heating water, such as pasteurization water; water reclamation and purification systems; membrane filtration water systems; food processing streams and waste treatment systems as well as in clarifiers, liquid-solid applications, municipal sewage treatment systems; and industrial or municipal water distribution systems.

The presently disclosed corrosion inhibitor compositions may be used in connection with a biocide, such as an oxidizing biocide. Biocides are commonly used in aqueous systems and the presently disclosed corrosion inhibitor compositions show a surprising chemical stability in the presence of biocides, such as bleach.

In certain aspects, the presently disclosed corrosion inhibitor compositions may comprise one or more of the following characteristics:

- Halogen stability up to about 0.5 ppm free residual chlorine (FRC);
- Ability to handle water temperatures up to about 60° C.;
- Compatibility with azoles, dispersants, and cooling water polymers;
- Calcium tolerance up to about 500 ppm as $CaCO_3$;
- Chloride tolerance up to about 600 ppm as Cl;
- Stability over a pH from about 6 to about 9;
- Low toxicity (e.g. $LC_{50}$>100 mg/L); and
- Stable for a Holding Time Index (HTI) of from a few seconds (e.g. 30 seconds, 60 seconds, 90 seconds, etc.) up to about 250 hours.

In particular aspects of the present disclosure, the corrosion inhibitors may be used in connection with warewashing compositions. Warewashing compositions may be used for protecting articles, such as glassware or silverware, from corrosion in a dishwashing or warewashing machine. However, it is to be understood that the warewashing compositions comprising the presently disclosed corrosion inhibitors can be available for cleaning environments other than inside a dishwashing or warewashing machine.

The corrosion inhibitor composition may be included in the warewashing composition in an amount sufficient to provide a use solution that exhibits a rate of corrosion and/or etching of glass that is less than the rate of corrosion and/or etching of glass for an otherwise identical use solution, except for the absence of the corrosion inhibitor composition. In some aspects, the use solution may include at least about 6 ppm of the corrosion inhibitor composition. In other aspects, the use solution may include between about 6 ppm and about 300 ppm of the corrosion inhibitor composition. In still further aspects, the use solution may include between about 20 ppm and about 200 ppm of the corrosion inhibitor composition. In the case of a warewashing composition concentrate that is intended to be diluted to a use solution, it is expected that the corrosion inhibitor composition may be provided at a concentration of between about 0.5 wt. % and about 25 wt. %, and between about 1 wt. % and about 20 wt. % of the concentrate.

In addition to the corrosion inhibitor composition, the warewashing composition and/or use solution may also include cleaning agents, alkaline sources, surfactants, chelating/sequestering agents, bleaching agents, detergent builders or fillers, hardening agents or solubility modifiers, defoamers, anti-redeposition agents, threshold agents, aesthetic enhancing agents (i.e., dye, perfume), and the like. Adjuvants and other additive ingredients will vary according to the type of composition being manufactured. It should be understood that these additives are optional and need not be included in the cleaning composition. When they are included, they can be included in an amount that provides for the effectiveness of the particular type of component.

The presently disclosed corrosion inhibitors may be used in connection with any warewashing operation or any warewashing composition, such as those warewashing compositions disclosed in U.S. Pat. No. 7,196,045, U.S. Pat. No. 7,524,803, U.S. Pat. No. 7,135,448, U.S. Pat. No. 7,759,299, U.S. Pat. No. 7,087,569, U.S. Pat. No. 7,858,574, and U.S. Pat. No. 8,021,493, the entire contents of each of these patents being expressly incorporated into the present application.

Any of the presently disclosed aqueous systems may be automatically monitored and controlled. For example, the pH of the systems may be monitored and controlled or the amount of corrosion inhibitor composition in the aqueous system may be monitored and controlled. In certain aspects, the aqueous system may include a monitoring and controlling unit that comprises a controller device and a plurality of sensors. Each of the plurality of sensors may be configured to obtain a different characteristic of the water and each sensor may also be in communication with the controller. The plurality of sensors can comprise, for example, sensors for measuring conductivity, corrosion inhibitor concentration, pH, oxidation/reduction potential (ORP), fluorescence, biocide concentration, turbidity, temperature, flow, and dissolved oxygen (DO) in the water.

Based on signals received from the sensors, the controller may send signals to chemical injection pumps, which are in fluid communication with various chemicals, such as acids, bases, biocides, corrosion inhibitors, scale inhibitors, etc., to turn the pumps off (cause them to stop adding chemical) or turn them on (cause them to add a specified amount of more chemical). The components of this automated system may be in communication with each other in any number of ways, including, as illustrative examples, through any combination of wired connection, a wireless connection, electronically, cellularly, through infrared, satellite, or according to any other types of communication networks, topologies, protocols, and standards.

As used herein, the term "controller" or "controller device" refers to a manual operator or an electronic device having components such as a processor, memory device, digital storage medium, a communication interface including communication circuitry operable to support communications across any number of communication protocols and/or networks, a user interface (e.g., a graphical user interface that may include cathode ray tube, liquid crystal display, plasma display, touch screen, or other monitor), and/or other components. The controller is preferably operable for integration with one or more application-specific integrated circuits, programs, computer-executable instructions or algorithms, one or more hard-wired devices, wireless devices, and/or one or more mechanical devices. Moreover, the controller is operable to integrate the feedback, feed-forward, or predictive loop(s) of the invention. Some or all of the controller system functions may be at a central location, such as a network server, for communication over a local area network, wide area network, wireless network, internet connection, microwave link, infrared link, wired network (e.g., Ethernet) and the like. In addition, other components such as a signal conditioner or system monitor may be included to facilitate signal transmission and signal-processing algorithms.

The disclosed monitoring and controlling system provides methods to generate real-time, on-line, reliable data from the water of the industrial system. Based upon the data received by the controller from the plurality of sensors, real-time adjustments can be made to the water. For example, the plurality of sensors may provide continuous or intermittent feedback, feed-forward, or predictive information to the controller, which can relay this information to a relay device, such as the Nalco Global Gateway, which can transmit the information via cellular communications to a remote device, such as a cellular telephone, computer, or any other device that can receive cellular communications. This remote device can interpret the information and automatically send a signal (e.g. electronic instructions) back, through the relay device, to the controller to cause the controller to make certain adjustments to the output of the chemical injection pumps. The information may also be processed internally by the controller and the controller can automatically send signals to the pumps, to adjust the amount of chemical injection. Based upon the information received by the controller from the plurality of sensors or from the remote device, the controller can transmit signals to the various pumps to make automatic, real-time adjustments, to the amount of chemical that the pumps are injecting into the water of the system.

In certain aspects, the remote device or controller can include appropriate software to receive data from the plurality of sensors and determine if the data indicates that one or more measured properties of the water are within, or outside, an acceptable range. The software can also allow the controller or remote device to determine appropriate actions that should be taken to remedy the property that is outside of the acceptable range. The monitoring and controlling system and/or controller disclosed herein can incorporate programming logic to convert analyzer signals from the plurality of sensors to pump adjustment logic and, in certain embodiments, control one or more of a plurality of chemical injection pumps with a unique basis.

Data transmission of measured properties or signals to chemical pumps, alarms, remote monitoring devices, such as computers or cellular telephones, or other system components is accomplished using any suitable device, and across any number of wired and/or wireless networks, including as illustrative examples, WiFi, WiMAX, Ethernet, cable, digital subscriber line, Bluetooth, cellular technologies (e.g., 2G, 3G, Universal Mobile Telecommunications System (UMTS), GSM, Long Term Evolution (LTE), or more) etc. The Nalco Global Gateway is an example of a suitable device. Any suitable interface standard(s), such as an Ethernet interface, wireless interface (e.g., IEEE 802.11a/b/g/x, 802.16, Bluetooth, optical, infrared, radiofrequency, etc.), universal serial bus, telephone network, the like, and combinations of such interfaces/connections may be used. As used herein, the term "network" encompasses all of these data transmission methods. Any of the described devices (e.g., archiving systems, data analysis stations, data capturing devices, process devices, remote monitoring devices, chemical injection pumps, etc.) may be connected to one another using the above-described or other suitable interface or connection.

Various additional automated methods that can be used in accordance with the present disclosure for monitoring and controlling industrial water systems are disclosed in U.S. Pat. No. 8,303,768, U.S. Patent Application Publication No. 2013/0161265, U.S. Patent Application Publication No. 2013/0233804, U.S. Patent Application Publication No. 2013/0233796, and U.S. Ser. No. 13/833,115, the contents of each of these documents being incorporated by reference into the present application in their entirety.

EXAMPLES

The following experiments represent the synthesis of various imidazoline derivatives and their properties as corrosion inhibitors.

Synthesis of Amino Imidazoline (Fatty Acid:DETA=1:1):

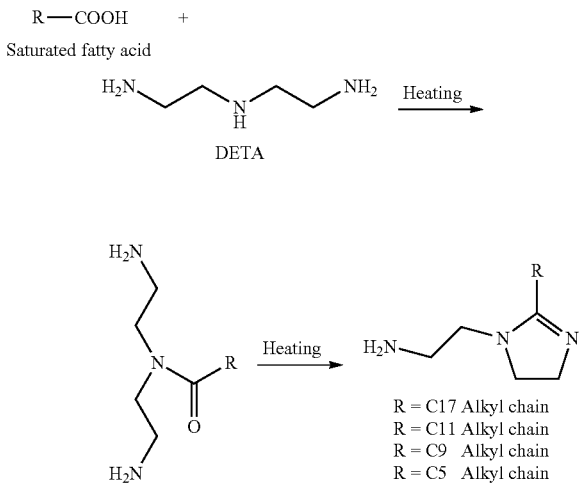

As an outline of the general procedure, about 20 grams (1.0 mol) of fatty acid was placed in a 250 ml, 4-neck flask, equipped with an overhead stirrer, thermocouple, addition funnel, and a Dean-Stark trap. Fatty acids were heated to about 60° C. and then about 1.2 mol of diethylenetriamine (DETA) was added dropwise rapidly. The resulting mixture color changed and exothermed to about 100° C. The mixture was then heated to about 175° C. for 3 hours while allowing water to collect in the Dean-Stark trap. The resulting mixture was then heated at about 225° C. for an additional 2 hours during which time any further evolved water was collected. The yields of all amino imidazoline derivatives were found to be greater than 85%.

Synthesis of Acrylated Amino Imidazoline:

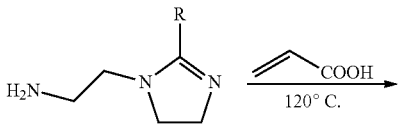

-continued

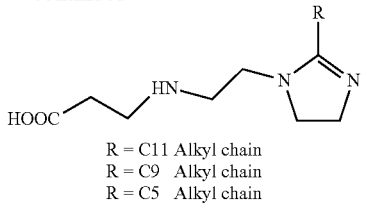

The resulting imidazoline from the synthesis described above was then reacted with the desired amount of acrylic acid, which was carefully added dropwise via a glass syringe to the imidazoline product. A temperature rise to about 80-85° C. was observed. After the exotherm had ceased, the reaction temperature was raised to about 120° C. for 2 hours. The resulting acrylated imidazoline was recovered.

Synthesis of Amido Imidazoline (Fatty Acid:DETA=2:1):

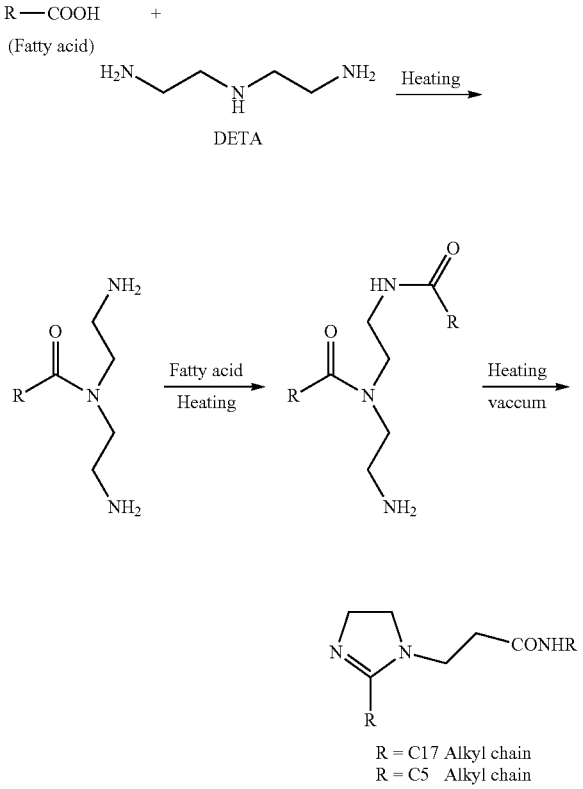

The following is a general procedure typically used for amido-imidazoline preparation. Diethylenetriamine (1.1 mol) was added to 40 grams (2 mol) fatty acid at about 80° C. The temperature quickly increased to about 120° C. and gelling occurred. This was overcome by warming above 125° C. Heating at about 150° C. was continued for 6 hours followed by additional heating at about 200° C. at 2 milibar vacuum for about 2 hours. The reaction mixture was cooled and recrystallized using acetone to obtain greater than 80% yields of amido imidazolines. While the products are imidazoline heterocycles, they will eventually undergo hydrolysis during use to a mixture of two different amidoamine hydrolysis products, and these may be the active corrosion inhibitor species in some aspects.

TABLE 1

List of synthesized substituted imidazolines:

| No. | Imidazoline derivative | Structure of product | Solubility in water |
|---|---|---|---|
| 1 | $C_6$ Amino Imidazoline | 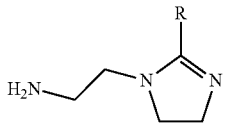 | No |
| 2 | $C_8$ Amino Imidazoline | | No |
| 3 | $C_{12}$ Amino Imidazoline | | No |
| 4 | $C_{18}$ Amino Imidazoline | | No |
| 5 | $C_6$ Acrylated Amino Imidazoline | 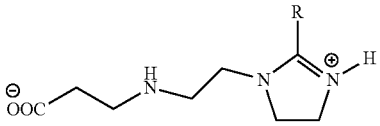 | Yes |
| 6 | $C_8$ Acrylated Amino Imidazoline | | Yes |
| 7 | $C_{12}$ Acrylated Amino Imidazoline | | Yes |
| 8 | $C_6$ Amido Imidazoline | 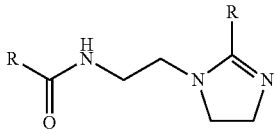 | Yes |
| 9 | $C_{12}$ Amido Imidazoline | | No |
| 10 | Propyl Sultone of $C_{12}$ Amido Imidazoline | 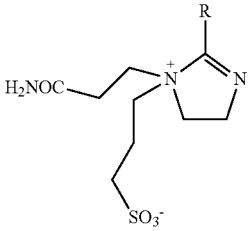 | No |

Corrosion Study

The electrochemical corrosion study was carried out using the Gamry electrochemical corrosion measurement technique. The purpose of the corrosion measurement was to evaluate the performance of the synthesized corrosion inhibitor compositions against Carbon Steel Metallurgy corrosion inhibition.

Experimental conditions used during the corrosion inhibition experiment were:

a) Corrosion rate KPI<3 mpy for Carbon Steel Metallurgy;

b) Gamry Electrochemical Instrument and Pine Rotator;

c) 800 mL test solution into a 1 L glass cell;

d) Dosage of Inhibitor: about 25 ppm;

e) Mild Steel cylindrical coupon polished using 600 SiC polishing paper;

f) No pre-passivation: unpassivated coupons were used directly after polishing;

g) Temperature: about 120° F. (50° C.);

h) pH=about 8.0; and i) RPM of Pine Rotator: 500 rpm.

TABLE 2

Water soluble imidazoline derivatives and their corrosion inhibition performance:

| Inhibitor | Corrosion Rate after 48 hrs (mpy) |
|---|---|
| $C_6$ Acrylated Amino Imidazoline | 4.01 |
| $C_8$ Acrylated Amino Imidazoline | 8.82 |
| $C_{12}$ Acrylated Amino Imidazoline | 5.62 |

TABLE 2-continued

Water soluble imidazoline derivatives and their corrosion inhibition performance:

| Inhibitor | Corrosion Rate after 48 hrs (mpy) |
|---|---|
| $C_6$ Amido Imidazoline | 11.20 |
| $C_6$ Acrylated Amino Imidazoline + Zn (2 ppm) | 2.94 |

FIG. 1 depicts a corrosion data plot for the water soluble amino, amido imidazolines and their acrylated derivatives. The $C_6$ chain length containing the acrylated amino imidazoline derivative showed the best performance for carbon steel corrosion inhibition at <5 mpy.

Figure 2:
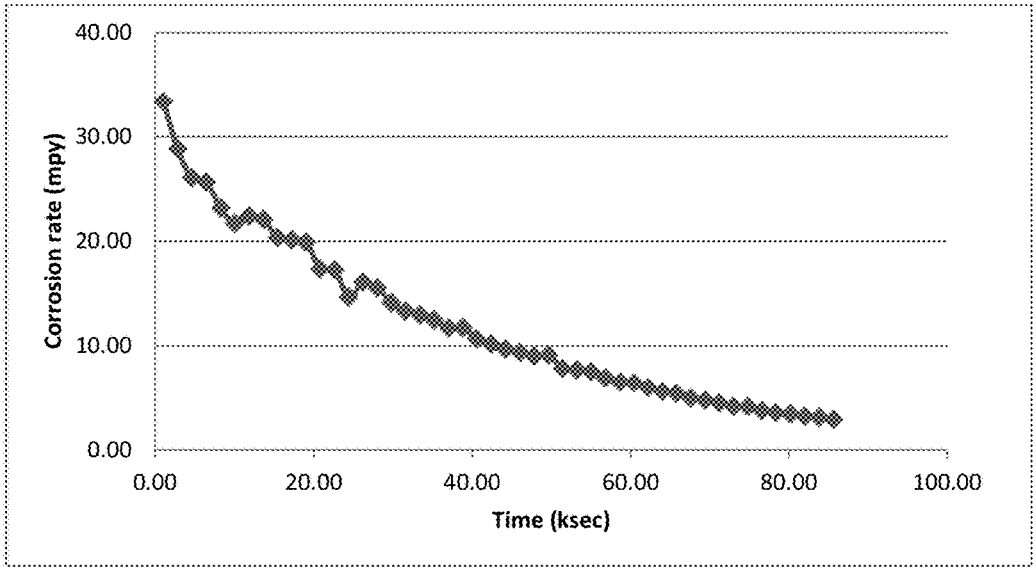
FIG. 2 shows a corrosion data plot for the $C_6$ acrylated imidazoline compound in presence of zinc.

The $C_6$ chain length containing the acrylated amino imidazoline derivative was then combined with zinc and the corrosion inhibition properties were tested using the conditions outlined above. FIG. 2 depicts a corrosion data plot for the $C_6$ acrylated imidazoline compound in presence of zinc (2 ppm as active) using an unpassivated mild steel coupon. For the water soluble $C_6$ acrylated amino imidazoline+2 ppm Zn, the corrosion rate was determined to be <3 mpy.

Figure 3:
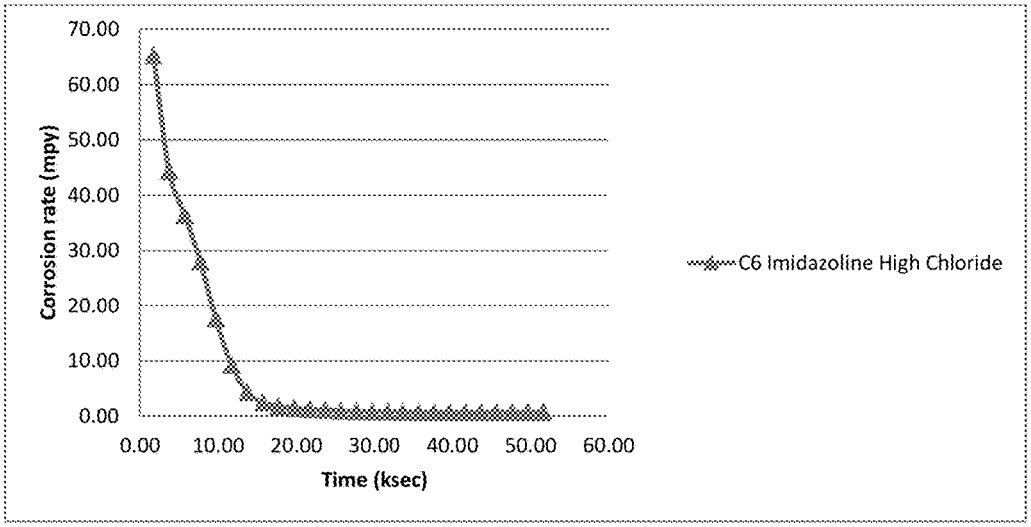
FIG. 3 shows a corrosion data plot of $C_6$ acrylated amino imidazoline in high chloride water chemistry conditions.

Additionally, the $C_6$ acrylated amino imidazoline showed an outstanding performance in high hardness and high chloride water chemistry. Specifically, it reaches <1 mpy when its performance is tested under high hardness and high chloride water chemistry conditions. It was also observed that the water chemistry does not become cloudy or result in any white precipitate after heating for 48 hours (which was the duration of the experiment). Although not wishing to be bound by any theories, the inventors consider that this is due to the presence of the acrylate group, which provides a scale inhibitor property of the molecule. This is an added advantage and an additional point of novelty of the $C_6$ acrylated amino imidazoline molecule. FIG. 3 shows the resulting data from this experiment using the $C_6$ acrylated amino imidazoline molecule under high chloride water chemistry conditions.

In conclusion, the presently disclosed corrosion inhibitor compositions have been shown to be water soluble, possess advantageous properties as corrosion inhibitors, and may be synthesized in very good yields.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a device" is intended to include "at least one device" or "one or more devices."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A corrosion inhibitor composition comprising the following general structure or a hydrolysis product or salt thereof:

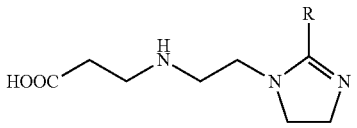

wherein the corrosion inhibitor composition is selected from the group consisting of 3-((2-(2-pentyl-4,5-dihydro-1H-imidazol-1-yl)ethyl)amino)propanoic acid, 3-((2-(2-heptyl-4,5-dihydro-1H-imidazol-1-yl)ethyl)amino)propanoic acid, 3-((2-(2-undecyl-4,5-dihydro-1H-imidazol-1-yl(ethyl) amino)propanoic acid, and 3-((2-(2-heptadecyl-4,5-dihydro-1H-imidazol-1-yl)ethyl)amino)propanoic acid.

2. The corrosion inhibitor composition of claim 1, wherein the composition excludes phosphorus.

3. The corrosion inhibitor composition of claim 1, further comprising zinc.

4. The corrosion inhibitor composition of claim 3, wherein a ratio of the corrosion inhibitor composition to the zinc is about 12.5:1.

5. The corrosion inhibitor composition of claim 1, further comprising an inorganic salt selected from the group consisting of zinc chloride, zinc nitrate, zinc nitrite, zinc sulfate, and any combination thereof.

6. The corrosion inhibitor composition of claim 1, further comprising an organic salt selected from the group consisting of zinc acetate, zinc citrate, and any combination thereof.

7. The corrosion inhibitor composition of claim 1, wherein the corrosion inhibitor composition is water soluble.

8. A method of inhibiting corrosion of a metallic surface in an aqueous system, comprising:

contacting the metallic surface with an effective amount of a corrosion inhibitor composition, wherein the corrosion inhibitor composition comprises the following general structure or a hydrolysis product or salt thereof:

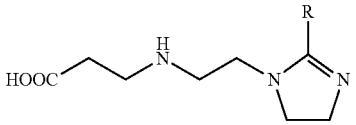

wherein the corrosion inhibitor composition is selected from the group consisting of 3-((2-(2-pentyl-4,5-dihydro-1H-imidazol-1-yl)ethyl)amino)propanoic acid, 3-((2-(2-heptyl-4,5-dihydro-1H-imidazol-1-yl)ethyl) amino)propanoic acid, 3-((2-(2-undecyl-4,5-dihydro-1H-imidazol-1-yl)ethyl)amino)propanoic acid, and 3-((2-(2-heptadecyl-4,5-dihydro-1H-imidazol-1-yl) ethyl)amino)propanoic acid.

9. The method of claim 8, wherein the effective amount is less than about 35 ppm.

10. The method of claim 8, wherein the corrosion inhibitor composition excludes phosphorus.

11. The method of claim 8, wherein the corrosion inhibitor composition further comprises an effective amount of zinc.

12. The method of claim 11, wherein the effective amount of zinc is from about 0.5 ppm to about 10 ppm.

13. The method of claim 11, wherein a ratio of the corrosion inhibitor composition to the zinc is about 12.5:1.

14. The method of claim 8, wherein the metallic surface comprises a ferrous metal.

15. The method of claim 8, wherein the aqueous system is selected from the group consisting of a once-through cooling water system, an open loop cooling water system, a closed loop cooling water system, a well casing, a transport pipeline, a boiler water system, a system used in power generation, a mineral processing water system, a paper mill digester, a washer, a bleach plant, a white water system, a mill water system, a black liquor evaporator, a gas scrubber, an air washer, a continuous casting system, an air conditioning system, a refrigeration system, a building fire protection water heating system, a pasteurization water system, a water reclamation system, a water purification system, a membrane filtration system, a food processing system, a waste treatment system, a sewage treatment system, a warewashing system, and a water distribution system.

* * * * *